United States Patent [19]

Wakita et al.

[11] Patent Number: 5,056,705

[45] Date of Patent: Oct. 15, 1991

[54] METHOD OF MANUFACTURING GOLF CLUB HEAD

[75] Inventors: Saburo Wakita; Junji Hoshi, both of Okegawa; Shinich Miyamoto; Hideo Kawabata, both of Omiya, all of Japan

[73] Assignee: Mitsubishi Metal Corporation, Tokyo, Japan

[21] Appl. No.: 555,181

[22] Filed: Jul. 18, 1990

[30] Foreign Application Priority Data

Jul. 19, 1989 [JP] Japan ..... 1-187155

[51] Int. Cl.[5] ..... B23K 31/02; B23K 103/14

[52] U.S. Cl. ..... 228/176; 228/263.21; 228/173.1; 273/167 H; 273/173; 164/76.1

[58] Field of Search ..... 228/176, 263.21, 182, 228/173.1; 29/DIG. 45; 164/76.1, 15, 35; 273/167 A, 167 H, 169, 173

[56] References Cited

U.S. PATENT DOCUMENTS 4,214,754 7/1980 Zebelean ..... 273/167 H
4,313,607 2/1982 Thompson ..... 273/167 H
4,417,731 11/1983 Yamada ..... 273/167 H
4,429,879 2/1984 Schmidt ..... 273/167 H
4,432,549 2/1984 Zebelean ..... 273/167 H
4,618,149 10/1986 Maxel ..... 273/167 X
4,944,515 7/1990 Shearer ..... 273/173

FOREIGN PATENT DOCUMENTS 63-154186 6/1988 Japan ..... 228/263.21

*Primary Examiner*—Samuel M. Heinrich
*Attorney, Agent, or Firm*—Scully, Scott, Murphy & Presser

[57] ABSTRACT

In a method of manufacturing a golf club head, at least a part of the golf club head is integrally precision-cast in titanium or an alloy thereof. The golf club head has a hollow section and a sole face provided therein with an opening communicating with the hollow section. A sole closure is manufactured by means of pressing. The sole closure is in agreement in dimension with the opening and is made of titanium or an alloy thereof. The sole closure made of the titanium or the alloy thereof is mounted to the opening in the golf club head in a sealed manner.

9 Claims, 4 Drawing Sheets

METHOD OF MANUFACTURING GOLF CLUB HEAD

BACKGROUND OF THE INVENTION

1. Field of the Invention

The present invention relates to methods of manufacturing golf club heads which have formed therein hollow sections and which are made of titanium or an alloy thereof and, more particularly, to a method of manufacturing a golf club head made of titanium or an alloy thereof, referred to as "metal wood".

2. Prior art

Conventionally, a head for a driver or the like in golf clubs is made of wood. The golf club generally has a metallic plate mounted to a sole face of the wood head, and an insert made of a resinous material or the like is mounted to a face of the head to reinforce the latter. In recent years, however, drivers and other golf clubs have appeared which have heads made of metal or an alloy thereof, called "metal wood". A golf club having a head made of metal or alloy thereof will hereinafter be referred to as "metal wood". Golfing using a metal wood lengthens the distance a hit ball will fly, improves aim accuracy, and generally facilitates hitting the ball. Thus, metal wood heads have been replacing wood heads in golf clubs such as drivers or the like.

Particularly, in recent years, it has been proposed to form a metal wood out of titanium or an alloy thereof which is superior in repulsion force and corrosion resistance and which is light in weight, as disclosed in, for example, Japanese Patent Provisional Publication No. SHO 63-154186. The head made of titanium or alloy thereof is manufactured in the following manner. That is, as shown in FIG. 6 of the attached drawings, the titanium or alloy thereof is pressed by a press machine to manufacture a face shell piece 111, an upper-face shell piece 112 and a sole-face shell piece 113. A balance weight 114 is mounted to an inner surface of the sole-face shell piece 113. Subsequently, the plurality of shell pieces 111, 112 and 113 are united together by means of welding. In this manner, the metal wood head is manufactured.

However, the following problems arise. That is, considerable skill is required to weld the plurality of pressed shell pieces in a clean or beautiful manner. Further, weld beads produced by the welding must be ground and polished so that surfaces of the weld beads are smoothed. Accordingly, the greater the length of the welds, the higher manufacturing costs.

Moreover, the following problems also arise. That is, if a plurality of pressed shell pieces having respective forged structures are welded together, strain remains at the welded or joined sections because the forged structures of the respective shell pieces are different from the welding structure of the weld beads. The longer the welding joined sections, the more the residual strain. Furthermore, if minute or fine weld defects such as pinholes or the like exist in the welding joined sections, cracks develop at the welding joined sections. Thus, it is impossible to adequately utilize the superior repulsion force of the titanium or alloy thereof.

The inventors of the present application have conducted research directed toward the manufacture of a head for a metal wood, which is low in manufacturing cost and which has fewer weld defects and less residual strain. As a result, the inventors have discovered the following.

A major part of the head, which has a small opening and a hollow section and which is made of titanium or an alloy thereof, is manufactured by precision casting. Then, a balance weight is inserted into the hollow section through the opening and is fixedly mounted to the head. Subsequently, the opening is closed, in a sealed manner, by a closure which is manufactured by pressing and which is made of titanium or an alloy thereof. The head thus produced has the following advantages. That is, since the weld bead for sealing the small opening is shortened, there is a reduction in weld defects and residual strain. Further, post-treatment after welding, such as grinding and polishing of the weld bead, is reduced. Thus, the manufacturing cost can be reduced considerably. Moreover, it is possible to sufficiently exhibit the repulsion force of the titanium or alloy thereof.

SUMMARY OF THE INVENTION

It is therefore an object of the invention to provide a method of manufacturing a head for a metal wood golf club, which is low in manufacturing cost and which has fewer weld defects and less residual strain.

According to the invention, there is provided a method of manufacturing a golf club head, comprising the steps of: precision-casting a golf club head body integrally by one of titanium and an alloy thereof, the golf club head body having a hollow section and an opening communicating with the hollow section and opening to a position corresponding to a sole face of the golf club head; manufacturing a sole closure by means of pressing, the sole closure being in agreement in dimension with the opening and being made of one of titanium and an alloy thereof; and mounting the sole closure to the opening in the golf club head, in a sealed manner.

With the above arrangement of the invention, the following superior advantages can be produced, because at least a part of the head made of the titanium or the alloy thereof is manufactured by the precision casting:

(a) It is possible to increase the dimension accuracy and the strength of the golf club head in its completed configuration, as compared with the conventional golf club head manufactured by bonding of the plurality of forged plate elements. Accordingly, it is possible to sufficiently exhibit the repulsion force and the aesthetic value which the titanium or alloy thereof originally has.

(b) Since it is possible to reduce the area of the opening which is to be sealed by welding, the length of the weld head is shortened. Thus, it is possible to reduce the weight error, residual strain and weld defects due to the weld bead. Further, it is possible to considerably reduce the time-consuming post-treatment after welding.

(c) Since the sole closure for sealing the opening is manufactured by the pressing, it is possible to manufacture the sole closure having stamped thereon desirable letters, characters, patterns, designs or the like, rapidly and at low cost.

DESCRIPTION OF THE PREFERRED EMBODIMENTS OF THE INVENTION

Figure 1:
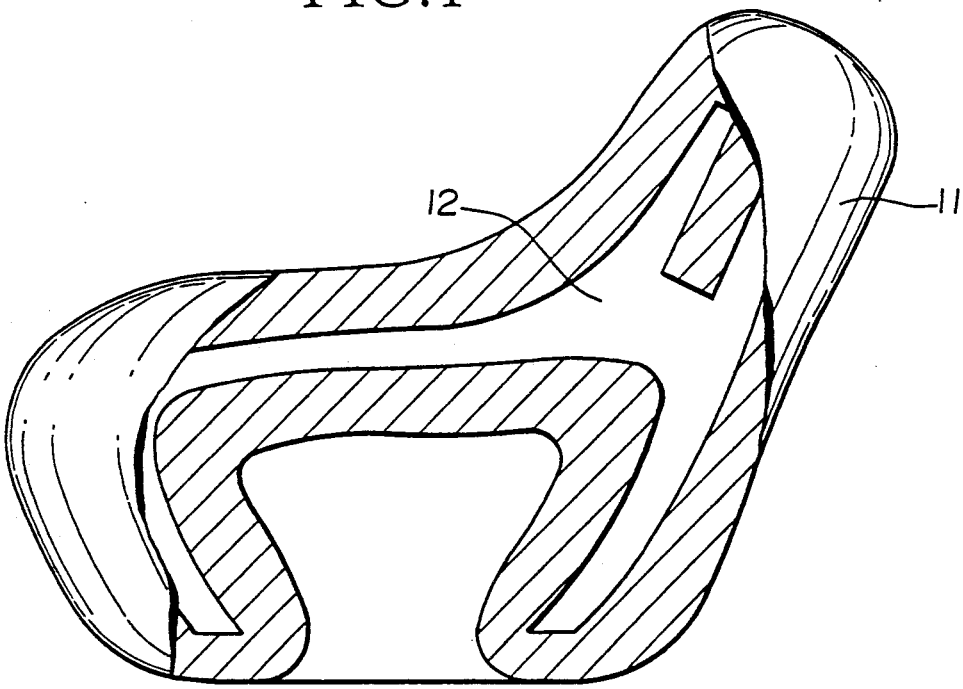
FIG. 1 is a partially broken-away, front elevational view of a mold for precision casting.

Referring to FIG. 1, there is shown, in a partially broken-away, front elevational view, a mold 11 for precision casting which is made of alumina and which is manufactured by a lost-wax process. The mold 11 for precision casting made of alumina is formed therein with a cavity 12 whose configuration is the same as that of a head for a metal wood. Molten titanium or an alloy thereof, for example, a titanium alloy containing 6% by weight of aluminum (Al), 4% by weight of vanadium (V) and balance titanium (Ti) is poured into the cavity 12 and is solidified, thereby manufacturing at least a part of the head for the metal wood.

Figure 2:
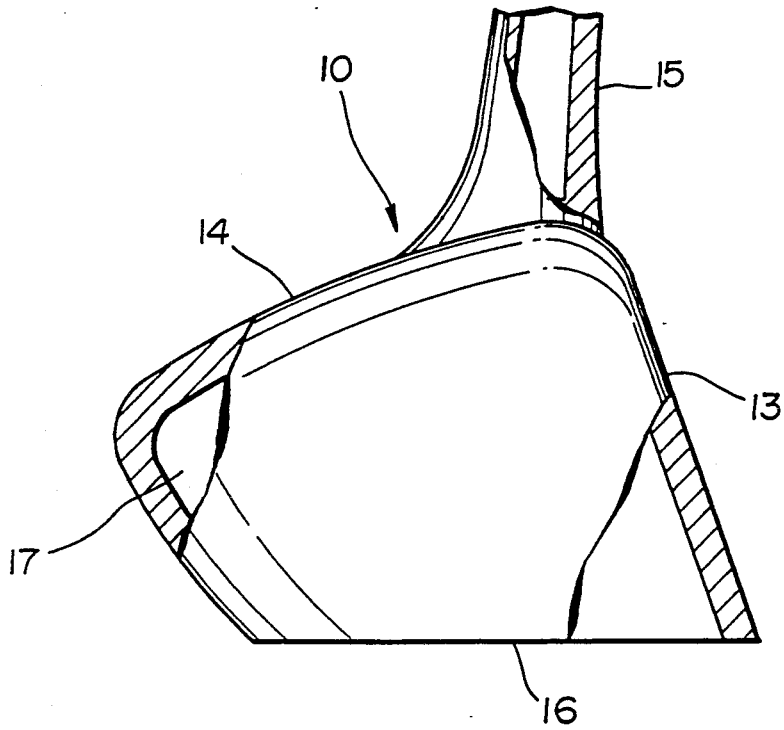
FIG. 2 is a partially broken-away, side elevational view of a cast article which is produced by the precision casting, using the mold illustrated in FIG. 1.

FIG. 2 is a partially broken-away, side elevational view of a cast article 10 forming the major part of the head which is manufactured by pouring molten titanium alloy into the cavity 12 in the mold 11 for precision casting. The cast article 10 has its head which has a face 13, an upper face 14, a shaft section 15, an opening 16 and a hollow section 17.

Figure 5:
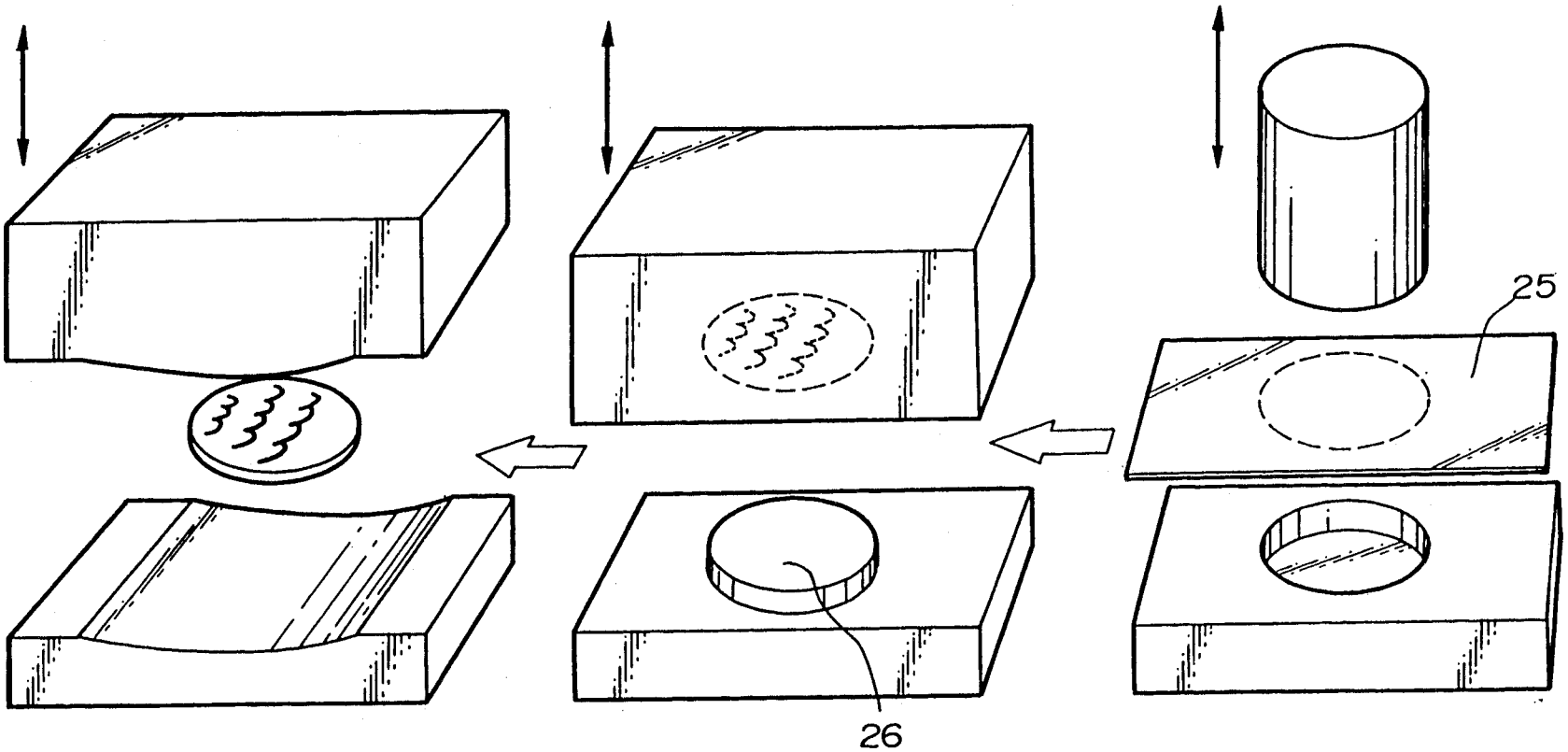
FIG. 5 is a view for explanation of steps of press-processing the sole closure illustrated in FIG. 3 or FIG. 4.
Figure 6:
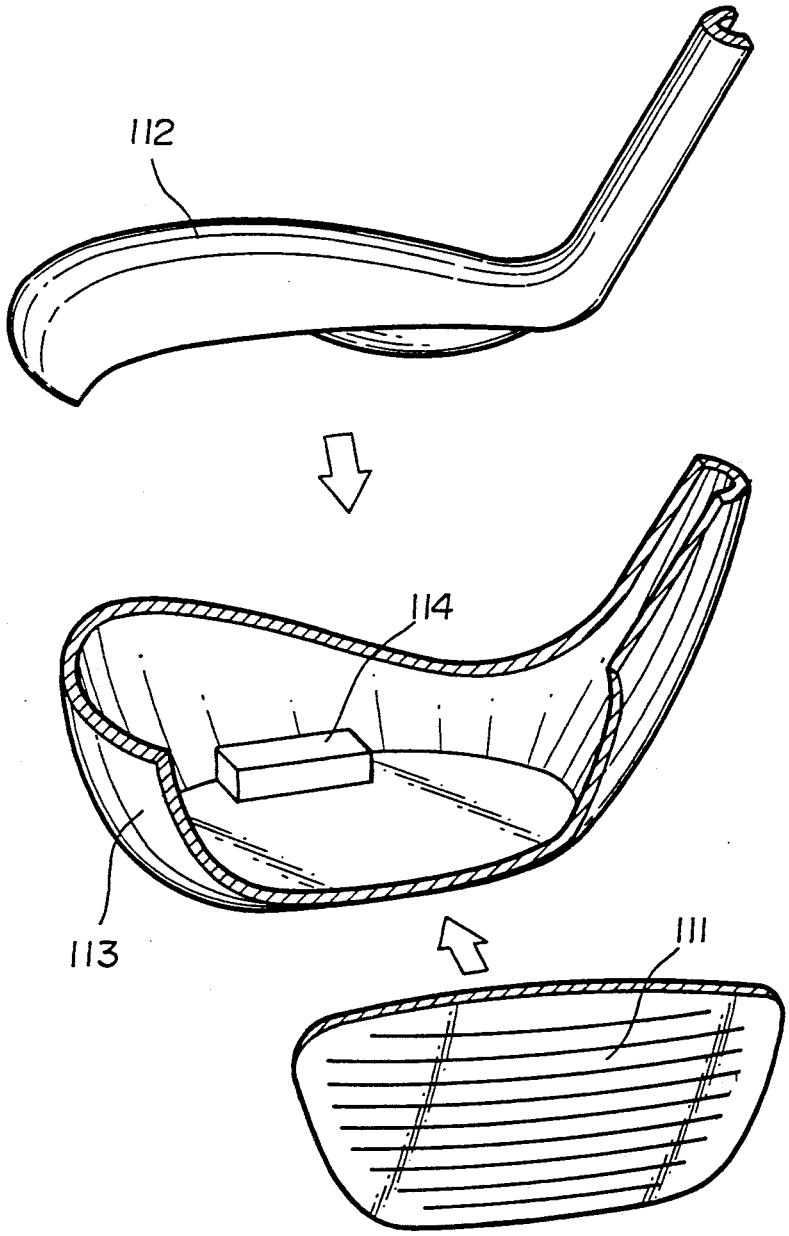
FIG.6 (PRIOR ART)
FIG. 6 is a view for explanation of a method of manufacturing the conventional golf club head which is made of titanium or an alloy thereof.

On the other hand, a sole lid or closure 19 (reference to FIG. 3), which has its configuration and dimension in agreement with the opening 16, is manufactured in the following manner. That is, as shown in FIG. 5, a pure titanium plate 25 is punched by the use of punching dies A to form a pouched plate 26 which has a dimension in agreement with the opening 16. Then, desired letters, characters, patterns, designs or the like are stamped on a surface thereof by the use of stamping dies B. Subsequently, bending dies C are used to give a curved surface to the punched plate element 26, so that the latter can be used as a predetermined sole closure.

In the foregoing, the punching dies A, the stamping dies B and the bending dies C are used to manufacture the sole closure 19 in three steps. However, the sole closure 19 having letters, characters, patterns, designs or the like may be manufactured in a single step by coining or embossing of a pure titanium plate.

Figure 3:
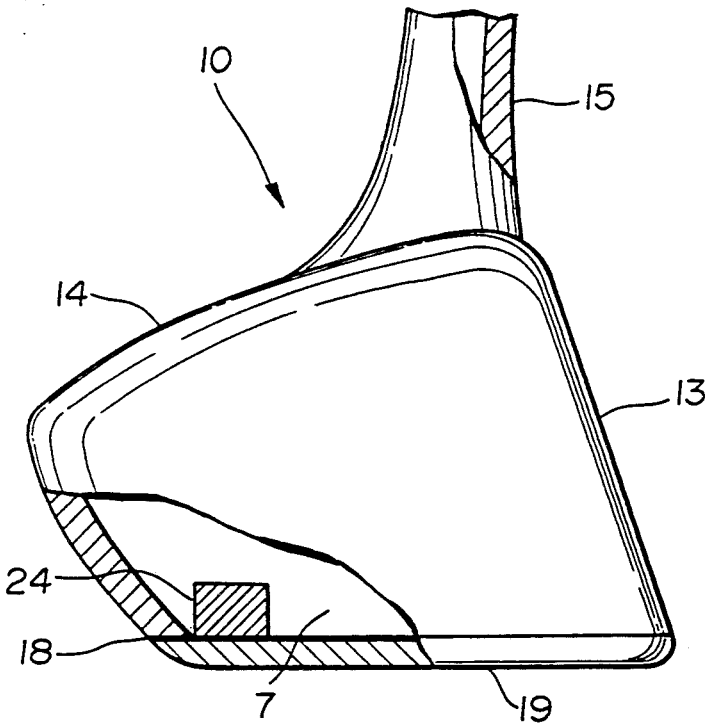
FIG. 3 is a partially broken-away, side elevational view of a golf club head which is manufactured in such a manner that a sole closure is welded to an opening in the cast article.

As shown in FIG. 3, a balance weight 24 is mounted to the rear side of the sole closure 19 manufactured by the pressing in the manner described above. Subsequently, the sole closure 19 is joined to the opening 16 and is welded together to the cast article 10, to close the opening 16 in a sealed manner.

Figure 4:
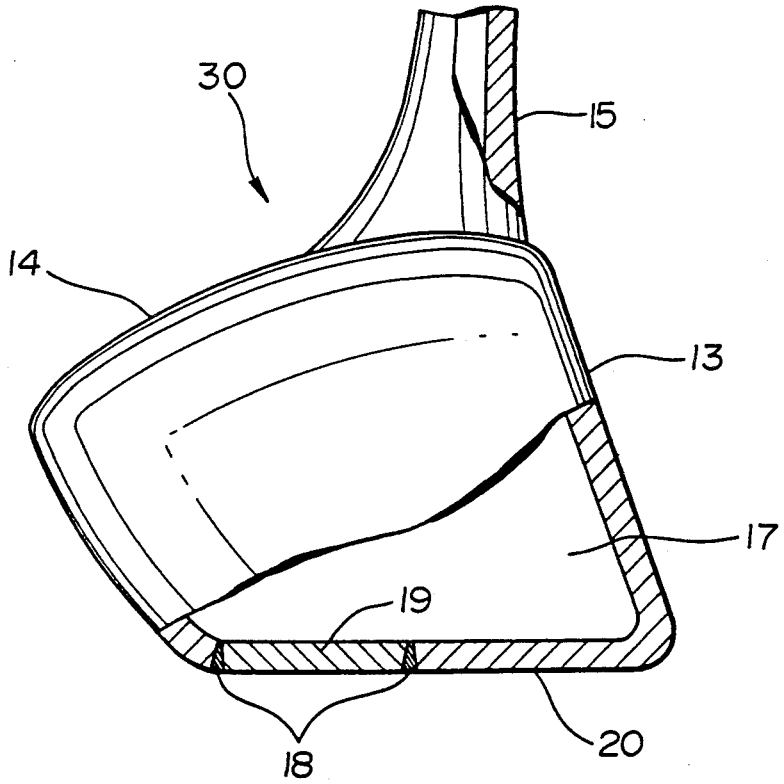
FIG. 4 is a partially broken-away, side elevational view of a golf club head according to another embodiment of the invention, the golf club head being produced by precision casting.

In the cast article 10 illustrated in FIG. 2, the opening 16 is provided in the entire sole face of the cast article 10. As shown in FIG. 4, however, the arrangement may be such that a part 20 of the sole face is manufactured integrally with a cast article 30 by precision casting to reduce the area of the opening 16 as far as possible, thereby shortening a weld portion as far as possible.

The cast article 10 or 30 illustrated in FIG. 2 or FIG. 4 is manufactured. The sole closure 19 is welded to the cast article 10 or 30. Subsequently, a surface of a weld bead 18 is ground and, then, is polished. Thus, the head for the metal wood is completed.

The opening may be provided in, for example, the upper face 14 or the face 13 of the head. It is not preferable, however, to provide a weld portion on the face 13, with respect to strength and residual strain. Further, it is also not preferable that the opening be provided in the upper face 14, a closure be welded to the opening in a sealed manner, and the weld portion be ground and polished to form a smooth surface. The reason for this is as follows. That is, the casting structure of the upper face, the forging structure of the closure manufactured by press processing, and the weld structure of the weld bead are different in optical reflectivity from each other in their respective metal structures. Thus, stripes of the weld bead are visible and reduce the aesthetic value of the golf club head.

Accordingly, it is most preferable that the opening be provided in the sole face.

What is claimed is:

1. A method of manufacturing a golf club head, comprising the steps of:

precision-casting a golf club head body integrally by one of titanium and an alloy thereof, said golf club head body having a hollow section and an opening communicating with said hollow section and opening to a position corresponding to a sole face of the golf club head;

manufacturing a sole closure by punching a plate made of pure titanium with a punching die so as to form a punched plate having dimensions in conformance with said opening, stamping a surface of said punched plate with a stamping die, and bending said punched plate with a bending die to provide said punched plate with a curved surface, thereby forming said sole closure; and welding said sole closure to said golf club head to cover said opening in said golf club head.

2. The method according to claim 1, wherein said precision-casting is carried out using a precision-cast mold produced by lost-wax process.

3. The method according to claim 1, wherein said opening is provided in the entire sole face of said golf club head.

4. The method according to claim 1, wherein said opening is provided in a part of said sole face of said golf club head.

5. The method according to claim 1, wherein said titanium alloy contains 6% by weight of aluminum, 4% by weight of vanadium and balance titanium.

6. The method according to claim 1, wherein said pressing includes coining.

7. The method according to claim 1, wherein said pressing includes embossing.

8. The method according to claim 1, further comprising the step of mounting a balance weight to a location within said hollow section, prior to said step of mounting said sole closure to said opening.

9. The method according to claim 8, wherein said balance weight is mounted to a rear side of said sole closure.

* * * * *